US007775418B2

(12) United States Patent
Walling

(10) Patent No.: US 7,775,418 B2
(45) Date of Patent: Aug. 17, 2010

(54) CARTON WITH MULTIPLE PLY END HANDLE REINFORCEMENT

(75) Inventor: Bradford J. Walling, Raleigh, NC (US)

(73) Assignee: MeadWestvaco Packaging Systems, LLC, Richmond, VA (US)

( * ) Notice: Subject to any disclaimer, the term of this patent is extended or adjusted under 35 U.S.C. 154(b) by 3 days.

(21) Appl. No.: 11/940,803

(22) Filed: Nov. 15, 2007

(65) Prior Publication Data

US 2008/0110967 A1 May 15, 2008

Related U.S. Application Data

(60) Provisional application No. 60/865,951, filed on Nov. 15, 2006.

(51) Int. Cl.
*B65D 5/462* (2006.01)
*B65D 5/46* (2006.01)

(52) U.S. Cl. ..... 229/117.16; 229/117.13

(58) Field of Classification Search ..... 229/117.16, 229/117.18, 117.12, 165, 180, 117.09, 117.14, 229/117.15, 117.17
See application file for complete search history.

(56) References Cited

U.S. PATENT DOCUMENTS 2,407,463 A * 9/1946 Williams ..... 229/117.16
2,459,939 A * 1/1949 Hill et al. ..... 229/117.16
2,568,204 A * 9/1951 Recser ..... 229/161
2,768,778 A * 10/1956 Ferguson et al. ..... 229/125.29
3,131,849 A * 5/1964 Paige ..... 229/117.16
2006/0169755 A1* 8/2006 Spivey ..... 229/117.16
2007/0131748 A1* 6/2007 Brand ..... 229/117.16

FOREIGN PATENT DOCUMENTS

CA 2413302 A1 6/2004
WO WO 2005/100193 A 10/2005
WO WO 2008/061168 A3 5/2008

* cited by examiner

*Primary Examiner*—Nathan J Newhouse
*Assistant Examiner*—Christopher Demeree
(74) *Attorney, Agent, or Firm*—MWV Intellectual Property Group

(57) ABSTRACT

A reinforced handle is provided in an end wall closure of a substantially tubular carton by forming a handle opening in a top end flap, and by aligning the handle opening with corresponding cutouts formed in respective side end flaps. Each cutout is provided with reinforcing flaps that align with at least the weight bearing edge of the handle opening. Each reinforcing flap is formed from the respective side end flap and folded out of the plane of the respective side end flap to be in face contacting relationship with that side end flap. Each reinforcing flap aligns its edge with the weight bearing edge of the handle opening. In this manner, the material at the weight bearing edge of the handle opening is at least three plies thick.

20 Claims, 15 Drawing Sheets

CARTON WITH MULTIPLE PLY END HANDLE REINFORCEMENT

RELATED APPLICATIONS

This application claims priority to U.S. Provisional Application No. 60/865,951, filed Nov. 15, 2006, the entirety of which is incorporated herein by reference.

TECHNICAL FIELD

This invention relates generally to packaging, and particularly, to a carton formed from a single blank having a reinforced integrated handle opening in an end wall.

BACKGROUND OF THE INVENTION

Carton manufacturers often face the challenge of providing a carton having ergonomic handle openings that are sufficiently strong to withstand the stress generated by the weight of articles enclosed. This is particularly so when the handle is integral to the end wall of the carton and when the burst strength of the material comprising the end wall is insufficient to avoid failure of the handle and the end wall itself. One approach to resolving this issue is to construct the carton from a stronger material such as corrugated board or from a sheet of material having a relatively higher strength. As fully enclosed cartons typically have six walls (top, sides, bottom, and ends) that are formed from a single sheet of material, and cost tends to increase according to the strength and thickness of material used to construct the carton walls, this approach introduces extra expense and inefficiencies as it effectively amounts to reinforcing all of the walls of the carton irrespective of the relative magnitude of the forces borne by each wall.

According to another approach, additional material is applied to or around the handle as needed to support its integrity as well as that of the end wall. For instance, a handle aperture in a carton end wall may be reinforced by outlining its edges with an additional layer of sheet material. However, it is often preferable to form a carton from a single sheet of material rather than to attach additional components to a carton or carton blank.

What is needed is a carton that is formed from a single blank, and which provides a reinforced integrated handle opening disposed in an end wall, where the carton walls are efficiently constructed without wasting expensive material in carton walls that are less likely to fail.

SUMMARY OF THE INVENTION

According to one aspect of the present invention, a carton with a reinforced handle is provided. The carton includes a first handle panel having a finger-receiving opening for defining in its proximity a handle area by which the carton may be lifted. The finger-receiving opening has a pair of first and second opposed edges. The handle panel is provided with a handle-reinforcing arrangement including first and second reinforcing flaps. The first reinforcing flap is hingedly connected to the handle panel along the first edge and folded about the first edge to reinforce the handle area. The second reinforcing flap is hingedly connected to the handle panel along a second flap fold line and folded about the second flap fold line to reinforce the handle area. The second flap fold line is disposed between the first and second edges of the finger-receiving opening such that the second flap fold line is spaced from the first edge.

In one embodiment of this aspect, the second flap fold line may be disposed such that the second flap fold line defines a part of a perimeter of the finger-receiving opening.

In another embodiment, the first edge of the finger-receiving opening may be substantially linear, and the second flap fold line may be substantially parallel to the first edge.

In another embodiment, the first and second reinforcing flaps may be struck from the handle panel such that at least a part of the finger-receiving opening is defined by folding the first and second reinforcing flaps out of the plane of the handle panel.

In another embodiment, the first reinforcing flap may be folded on the handle panel to reinforce the handle area, and the second reinforcing flap may be folded on the first reinforcing flap so that the first reinforcing flap is sandwiched between the second reinforcing flap and the handle panel. Alternatively, the second reinforcing flap may be folded on the handle panel to reinforce the handle area, and the first reinforcing flap may be folded on the second reinforcing flap so that the second reinforcing flap is sandwiched between the first reinforcing flap and the handle panel.

In a further embodiment, the handle-reinforcing arrangement may further include a third reinforcing flap hingedly connected to the handle panel along a third flap fold line and folded about the third flap fold line to reinforce the handle area. The third flap fold line may be disposed between the second flap fold line and second edge of the finger-receiving opening such that the third flap fold line is spaced from the second flap fold line edge. In this embodiment, the third flap fold line may be disposed such that the third flap fold line defines a part of a perimeter of the finger-receiving opening.

In a still further embodiment, the carton may further include a second handle panel having a handle opening, and the second handle panel may be disposed in face-contacting relationship with the first handle panel such that the handle opening is aligned with at least a part of the finger-receiving opening.

In a still further embodiment, the second flap fold line may include a pair of spaced collinear fold line segments. The second reinforcing flap may include a reinforcing edge extending between the fold line segments such that at least a part of the reinforcing edge is brought into alignment with the first edge of the finger-receiving opening when the second reinforcing flap is folded to reinforce the handle area.

According to another aspect, a blank for forming the above carton is provided. The blank includes a first handle panel having a finger-receiving opening for defining in its proximity a handle area by which the carton may be lifted. The finger-receiving opening has a pair of first and second opposed edges. The handle panel is provided with a handle-reinforcing arrangement comprising first and second reinforcing flaps. The first reinforcing flap is hingedly connected to the handle panel along the first edge to reinforce the handle area when folded about the first edge. The second reinforcing flap is hingedly connected to the handle panel along a second flap fold line to reinforce the handle area when folded about the second flap fold line. The second flap fold line is disposed between the first and second edges of the finger-receiving opening such that the second flap fold line is spaced from the first edge.

DETAILED DESCRIPTION

Figure 1:
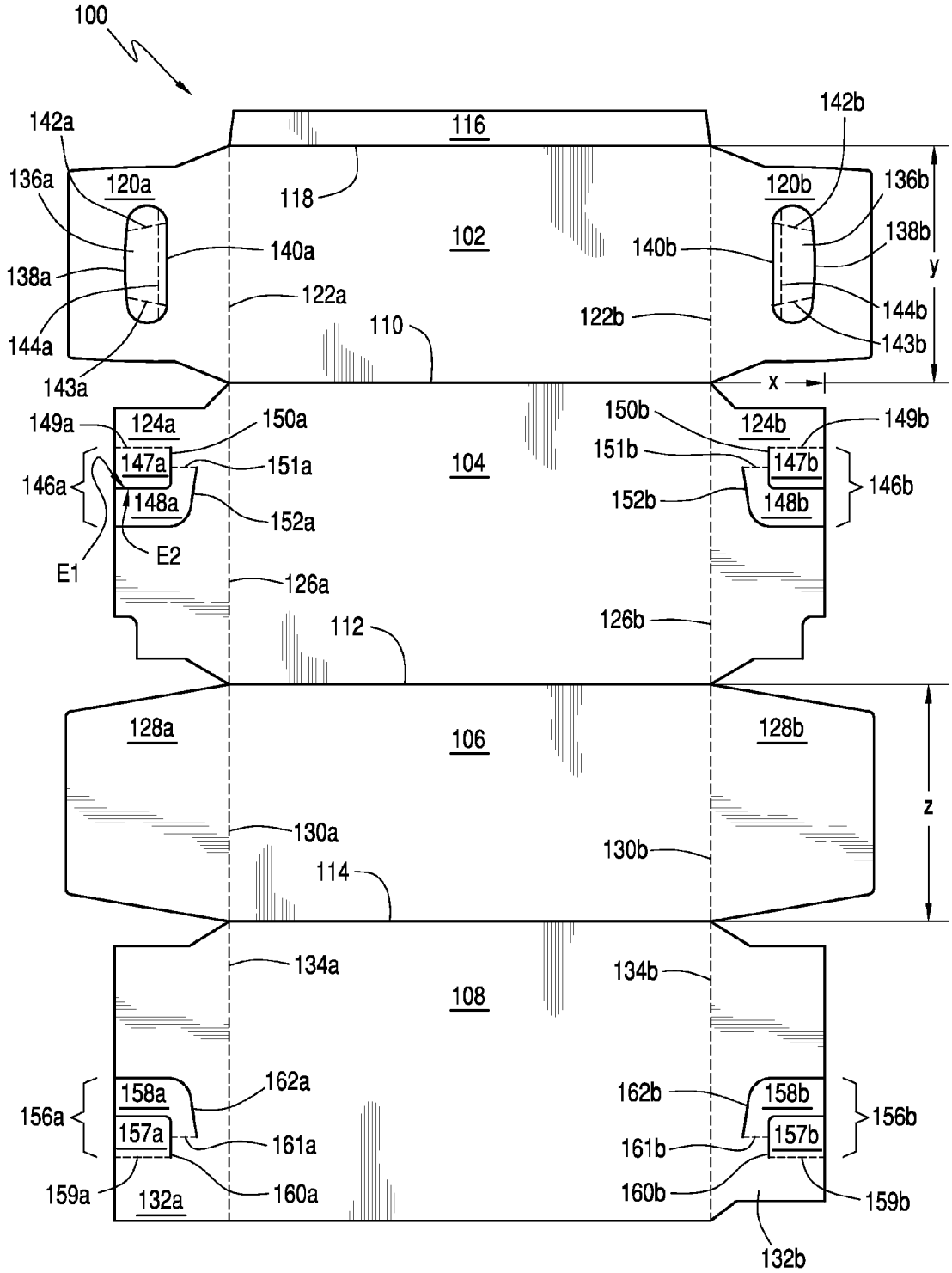
FIG. 1 is a plan view of a blank for forming a carton according to an exemplary embodiment of the invention.

As required, detailed embodiments of the present invention are disclosed herein. It will be understood that the disclosed embodiments are merely examples to illustrate aspects of the invention that may be embodied in various and alternative forms. The figures are not necessarily to scale, and some features may be exaggerated or minimized to show details of particular components. In other instances, well-known materials or methods have not been described in detail to avoid obscuring the present invention. Therefore, specific structural and functional details disclosed herein are not to be interpreted as limiting, but as a basis for the claims and for teaching one skilled in the art to variously employ the present invention.

Referring now to the drawings in which like numerals indicate like elements throughout the several views, the drawings illustrate certain of the various aspects of exemplary embodiments of a carton having reinforced end handles. The exemplary embodiments of the carton of the present invention are for enclosing, carrying, and dispensing articles such as beverage cans or bottles, although the cartons of the present invention may be utilized to package any suitable article. Generally described, the exemplary cartons are formed from a foldable sheet material such as paperboard, corrugated board, plastic, or the like.

Referring now to FIG. 1, to manufacture the first exemplary carton 200, the blank 100 is cut from a single sheet of the foldable sheet material, although it is contemplated that the blank 100 may include several separate panels that are secured together. The inside surface of the blank 100 is shown. The blank 100 includes four major panels, namely, a top panel 102, a first side panel 104, a bottom panel 106, and a second side panel 108. The panels 102, 104, 106, 108 are hingedly connected to one another along the length of the blank. More specifically, a first side edge of top panel 102 is hingedly connected along fold line 110 to a side edge of first side panel 104. A side edge of first side panel 104 is hingedly connected along fold line 112 to a side edge of bottom panel 106. A side edge of bottom panel 106 is hingedly connected along fold line 114 to a side edge of second side panel 108. A second side edge of top panel 102 is hingedly connected along fold line 118 to an edge flap 116. The edge flap 116 can be used to secure the second side panel 108 to the top panel 102 via adhesive, although any means for securing the second side panel 108 to the top panel 102 may be used.

Each of the panels 102, 104, 106, 108 is also hingedly attached at each end edge thereof to end flaps for forming end closures at each end of the erected carton 200, as will be described in greater detail below. The top panel 102 is hingedly connected to top end flaps 120*a*, 120*b* at end edges defined by fold lines 122*a*, 122*b*. The first side panel 104 is hingedly connected to first side end flaps 124*a*, 124*b* along end edges defined by fold lines 126*a*, 126*b*. The bottom panel 106 is hingedly connected to bottom end flaps 128*a*, 128*b* along end edges defined by fold lines 130*a*, 130*b*. The second side end panel 108 is hingedly connected to second side end flaps 132*a*, 132*b* along end edges defined by fold lines 134*a*, 134*b*.

To provide the reinforced end handles H (best shown in FIG. 5) on each end of the carton 200, handle openings or cutouts having complementary positions are provided in at least some of the end flaps. More specifically: the top end flaps 120*a*, 120*b* include cushioning flaps 136*a*, 136*b*; the first side end flaps 124*a*, 124*b* include handle cutouts 144*a*, 144*b*; and second side end flaps 132*a*, and the 132*b* include handle cutouts 152*a*, 152*b*, respectively.

The cushioning flaps 136*a*, 136*b* can be folded into the assembled carton to form handle openings comprising an aperture defined by an endless edge (138*a*, 138*b*, respectively) that defines an ergonomic shape suitable for receiving the fingers of a user's hand so that the carton 200 can be lifted and carried easily. The cushioning flaps 136*a*, 136*b*, once folded into the carton, can act to cushion the fingers of the user's hand. In the embodiment shown, the shape chosen for the handles includes an upper segment defined by fold lines 140*a*, 140*b*. The remainder of endless edge 138*a*, 138*b* (that portion not comprising fold line 140*a*, 140*b*, respectively) can comprise a severance line which can be broken by the fingers of a user's hand. Fold lines 140*a*, 140*b*, 142*a*, 142*b*, 143*a*, 143*b*, 144*a*, 144*b* are provided to aid the user in folding the cushioning flaps into the assembled carton. Fold lines 144*a*, 144*b* extend substantially parallel to fold lines 140*a*, 140*b*, respectively. The distance between fold lines 144*a*, 144*b*, and fold lines 140*a*, 140*b*, respectively can be a function of the number of reinforcement plies used for the handle openings as will be described in further detail below.

Each of the handle cutouts 146*a*, 146*b*, 156*a*, 156*b*, provides an open area such that when the carton is assembled, the fingers of a user's hand can extend though the handle openings and into the interior of the carton. In addition, as will be shown in further detail below, the sheet material formerly in the areas 146*a*, 146*b*, 156*a*, 156*b*, is not removed from the end flaps and merely discarded, but is instead repositioned to create a multiple ply reinforcement area for the handles H. Primary reinforcement flaps 147*a*, 147*b*, 157*a*, 157*b*, are cut along severance lines 150*a*, 150*b*, 160*a*, 160*b* and folded along lines 149*a*, 149*b*, 159*a*, 159*b* toward the interior of the carton, respectively. The fold lines 149*a*, 149*b*, 159*a*, 159*b* can be scored or otherwise weakened to permit a tighter fold. Alternatively, the primary reinforcement flaps can be separated along lines 149*a*, 149*b*, 159*a*, 159*b* and repositioned as if folded at these lines. From the perspective shown in FIG. 1, the primary reinforcement flaps 147*a* and 147*b* are to be folded upward, and primary reinforcement flaps 157*a* and 157*b* are to be folded downward. The primary reinforcement flaps 147*a*, 147*b*, 157*a*, 157*b* can be held in a face contacting arrangement with the side flaps 124*a*, 124*b*, 132*a*, 132*b*, respectively using adhesive or other modes of attachment. The secondary reinforcement flaps 148*a*, 148*b*, 158*a*, 158*b*, are cut along severance lines 152*a*, 152*b*, 162*a*, 162*b* and folded along fold lines 151*a*, 151*b*, 161*a*, 161*b* toward the interior of the carton, respectively. The fold lines 151*a*, 151*b*, 161*a*, 161*b* can be scored or otherwise weakened to permit a tighter fold. It can be seen from FIG. 1 and FIGS. 2-6 which follow, that a distal edge E1 of the primary reinforcement flap 147*a* is defined by a reinforcing edge E2 of the secondary reinforcement flap 148*a*.

Alternatively, the secondary reinforcement flaps can be cut along lines 151*a*, 151*b*, 161*a*, 161*b* and repositioned as if folded at these lines. From the perspective shown in FIG. 1, secondary reinforcement flaps 148*a* and 148*b* are to be folded upward, and the secondary reinforcement flaps 158*a* and 158*b* are to be folded downward. The secondary reinforcement flaps can be held in a face contacting position to the primary reinforcement flaps 147*a*, 147*b*, 157*a*, 157*b*, respectively using adhesive or other modes of attachment.

Figure 2:
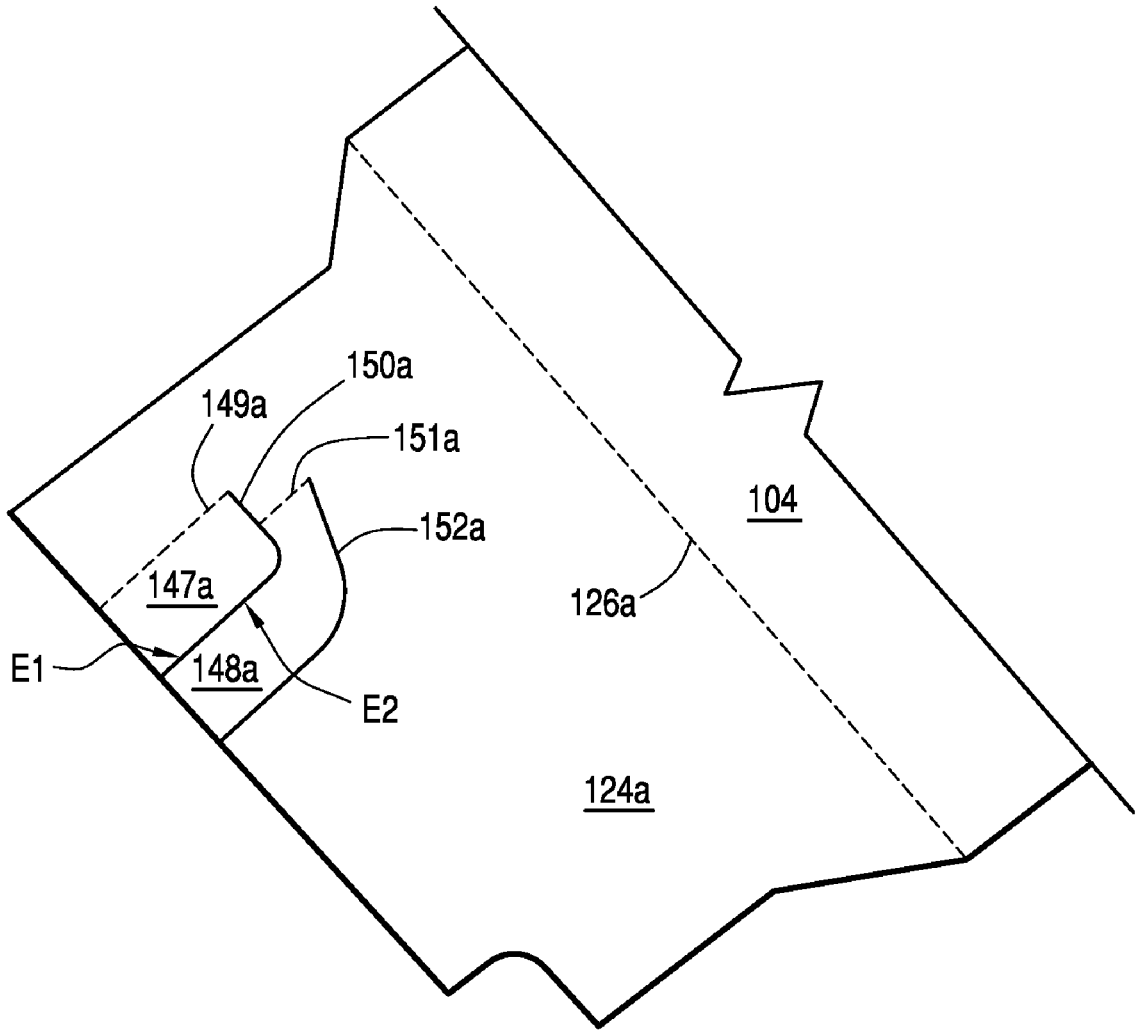
FIG. 2 is a perspective view of a side end panel of the blank of FIG. 1.
Figure 3:
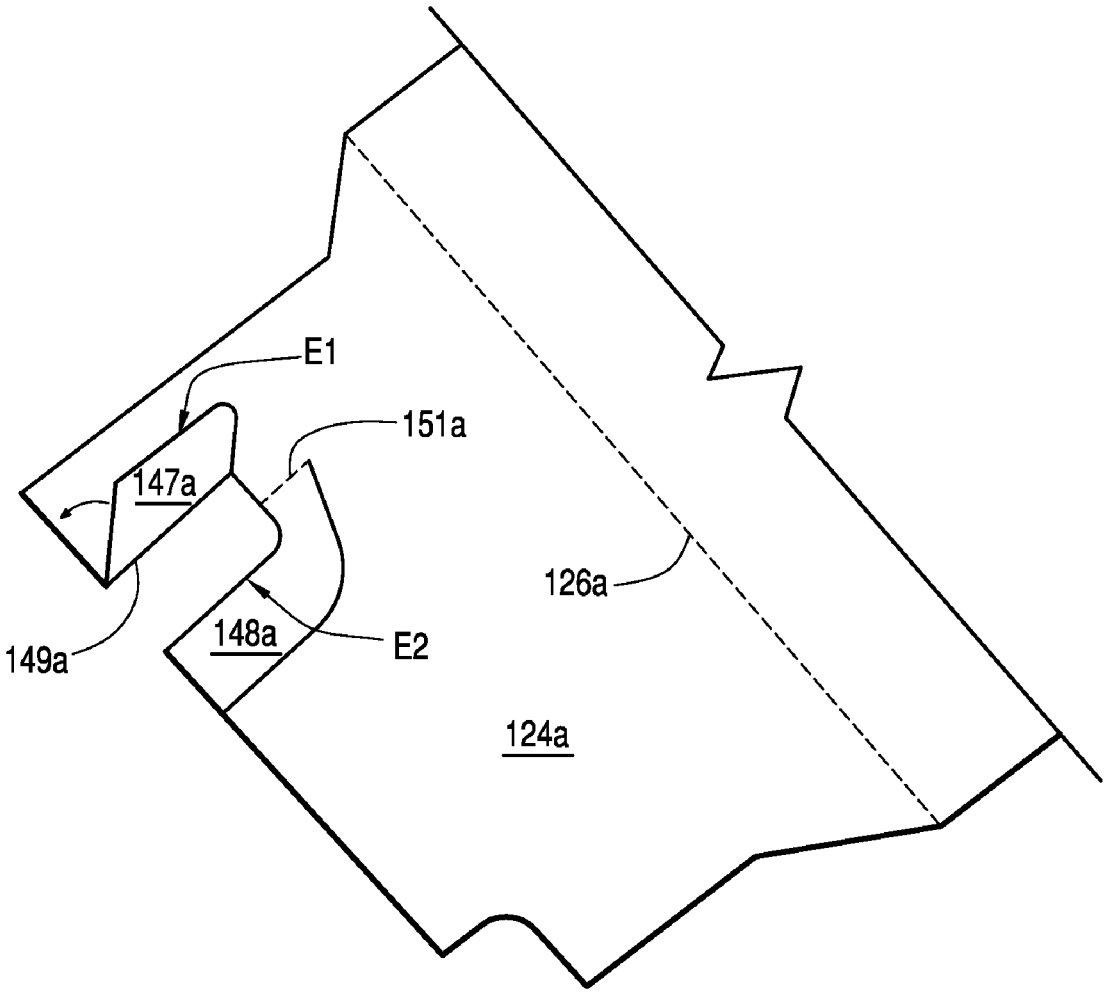
FIG. 3 is a perspective view of the side end panel of FIG. 2 showing a partially folded primary reinforcement panel.
Figure 4:
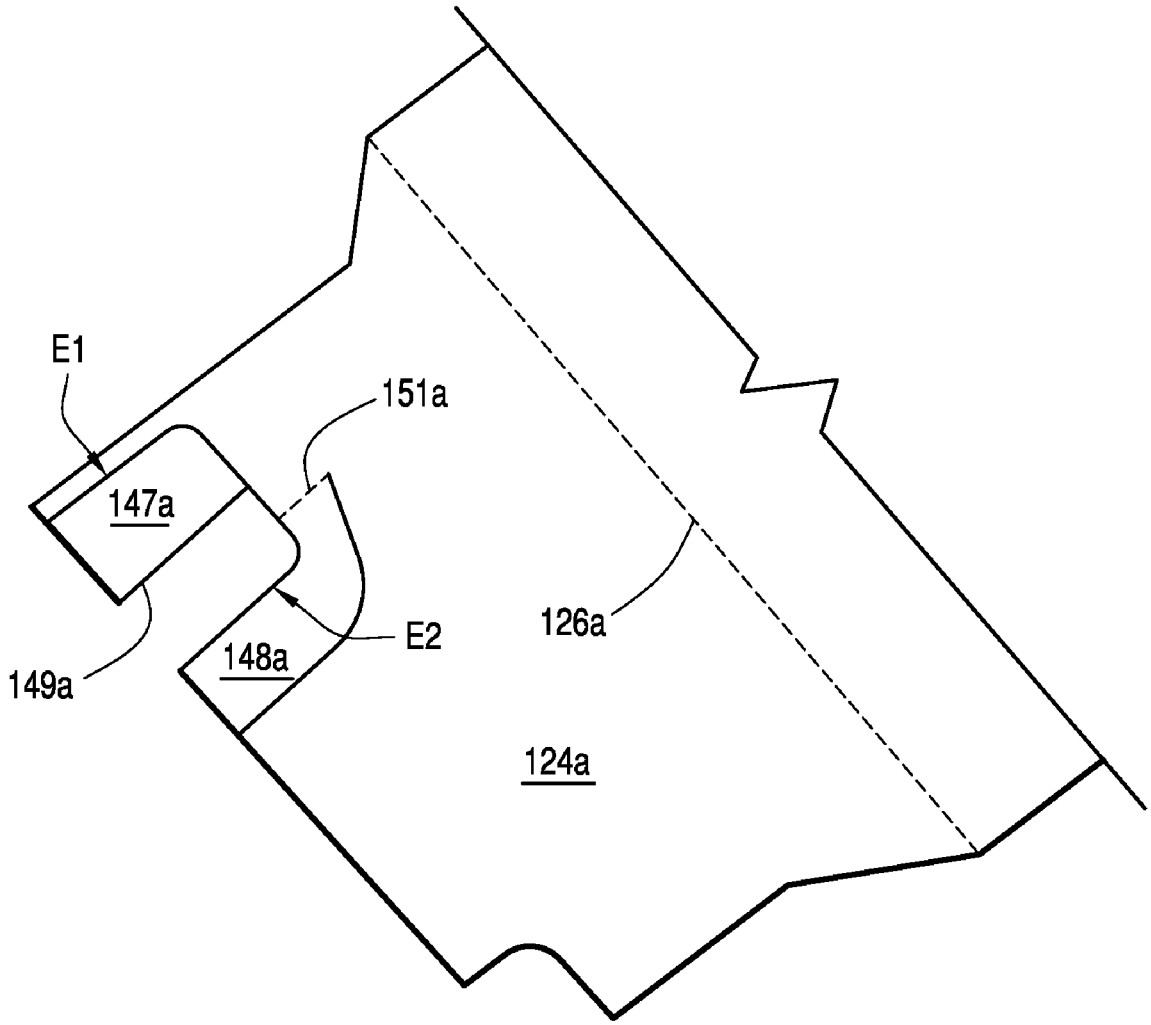
FIG. 4 is a perspective view of the side end panel of FIG. 2 showing a fully folded primary reinforcement panel in a face contacting arrangement with the side end panel.
Figure 5:
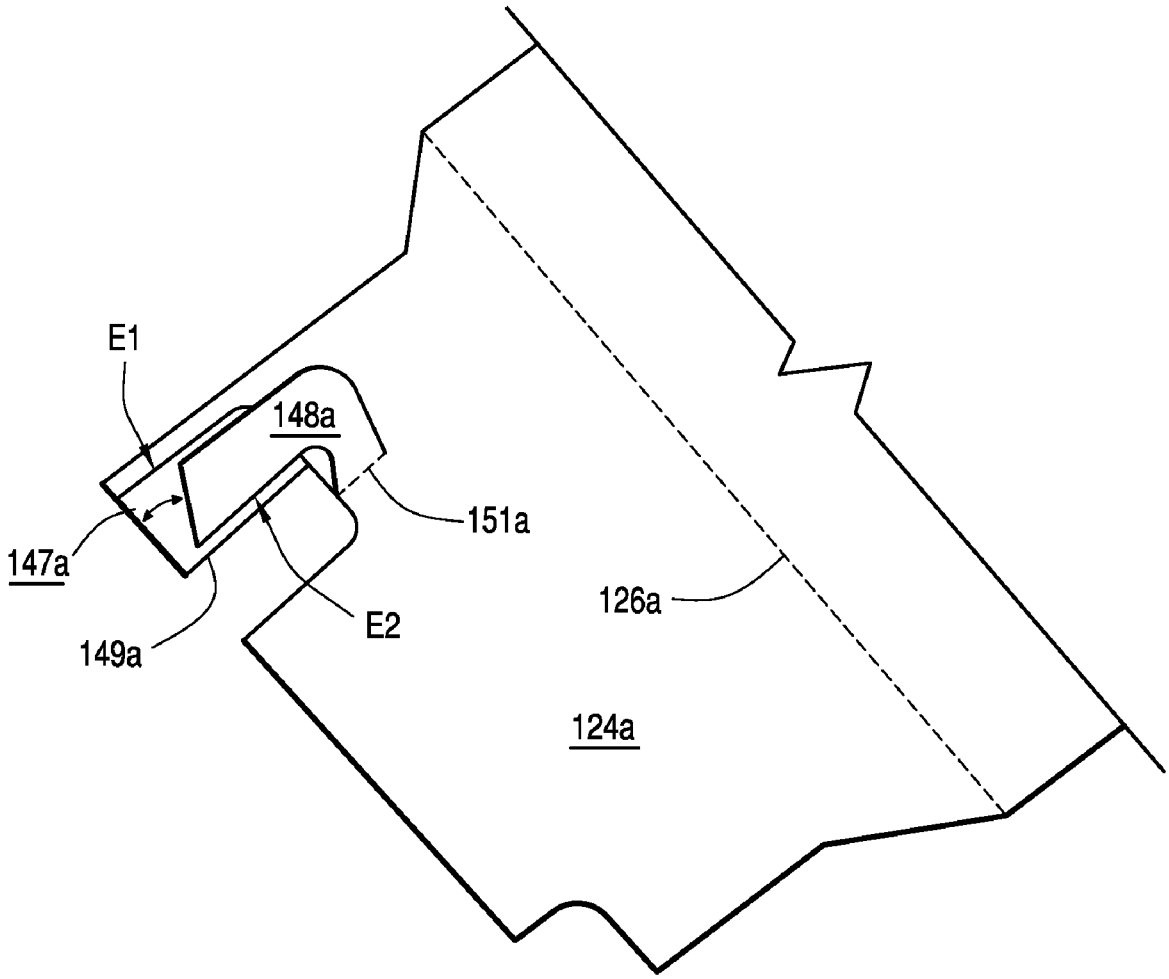
FIG. 5 is a perspective view of the side end panel of FIG. 4 showing a partially folded secondary reinforcement panel.
Figure 6:
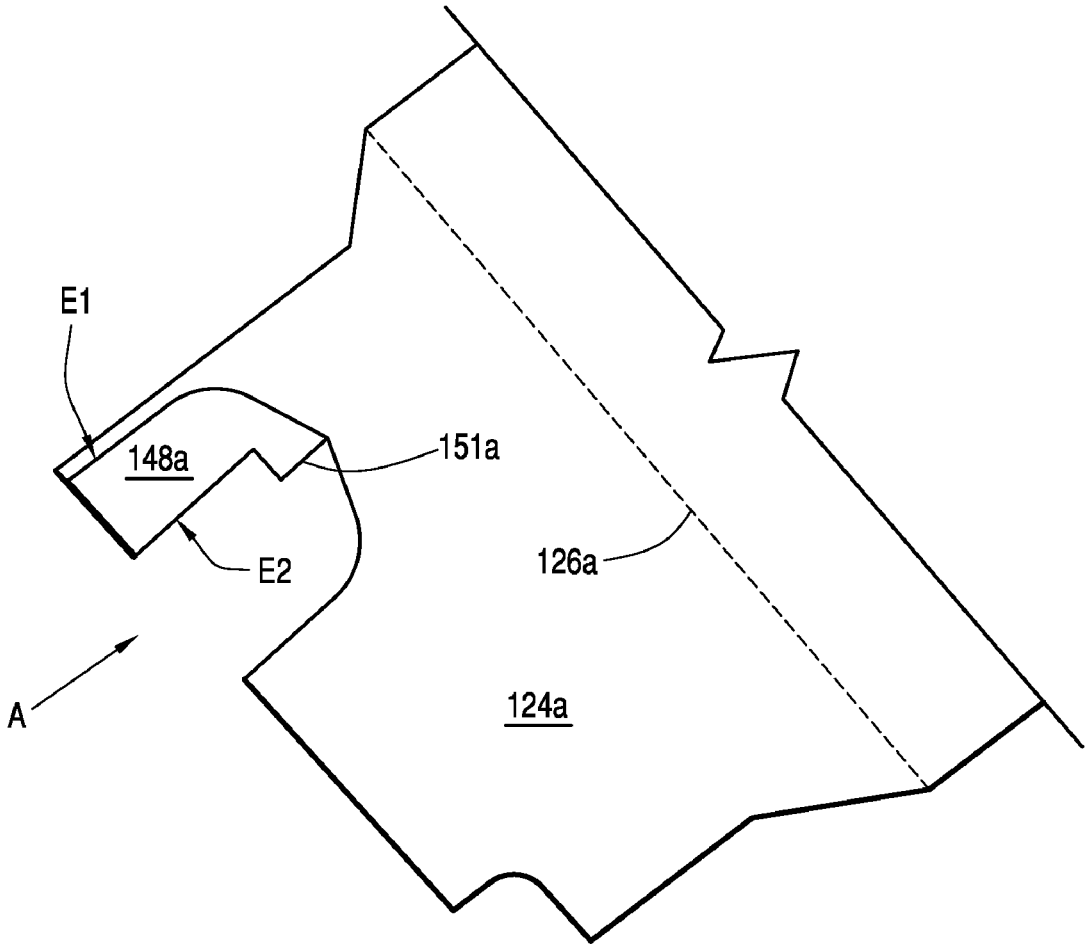
FIG. 6 is perspective view of the side end panel of FIG. 4 showing a fully folded secondary reinforcement panel in a face contacting arrangement with the primary reinforcement panel and the side end panel.

FIGS. 2-6 depict the folding of the primary reinforcement flap 147*a* and the secondary reinforcement flap 148*a* of side flap 124*a*. FIG. 2 shows a perspective view of the primary reinforcement flap 147*a* and the secondary reinforcement flap 148*a*, both in unfolded positions. FIG. 3 shows the primary reinforcement flap 147*a* in a partially folded position and the secondary reinforcement flap 148*a* in an unfolded position. FIG. 4 shows the primary reinforcement flap 147*a* in a fully folded position and the secondary reinforcement flap 148*a* in an unfolded position. FIG. 5 shows the primary reinforcement flap 147*a* in a fully folded position and the secondary reinforcement flap 148*a* in a partially folded position. FIG. 6 shows the primary reinforcement flap 147*a* in a fully folded position and the secondary reinforcement flap 148*a* in a fully folded position.

In the described embodiment, the primary reinforcement flaps are folded toward the interior of the carton prior to the folding of the secondary reinforcement flaps, such that the primary reinforcement flaps are disposed between the side flaps and the secondary reinforcement flaps. However, it is within the scope of the present invention for the secondary flaps to be folded prior to the folding of the primary reinforcement flaps.

As mentioned above, the reinforcement flap fold lines, 149*a*, 149*b*, 151*a*, 151*b*, 159*a*, 159*b*, 161*a*, 161*b* can be scored to enable the flaps to be folded into a substantially flat position against the end flaps 124*a*, 124*b*, 132*a*, 132*b* (and against the primary reinforcement flaps in the case of the secondary reinforcement flaps). Alternatively, the reinforcement flaps can be cut at the lines 149*a*, 149*b*, 151*a*, 151*b*, 159*a*, 159*b* and attached as described above in substantially the same position as if the flaps had been folded at the lines 149*a*, 149*b*, 151*a*, 151*b*, 159*a*, and 159*b*.

Figure 9:
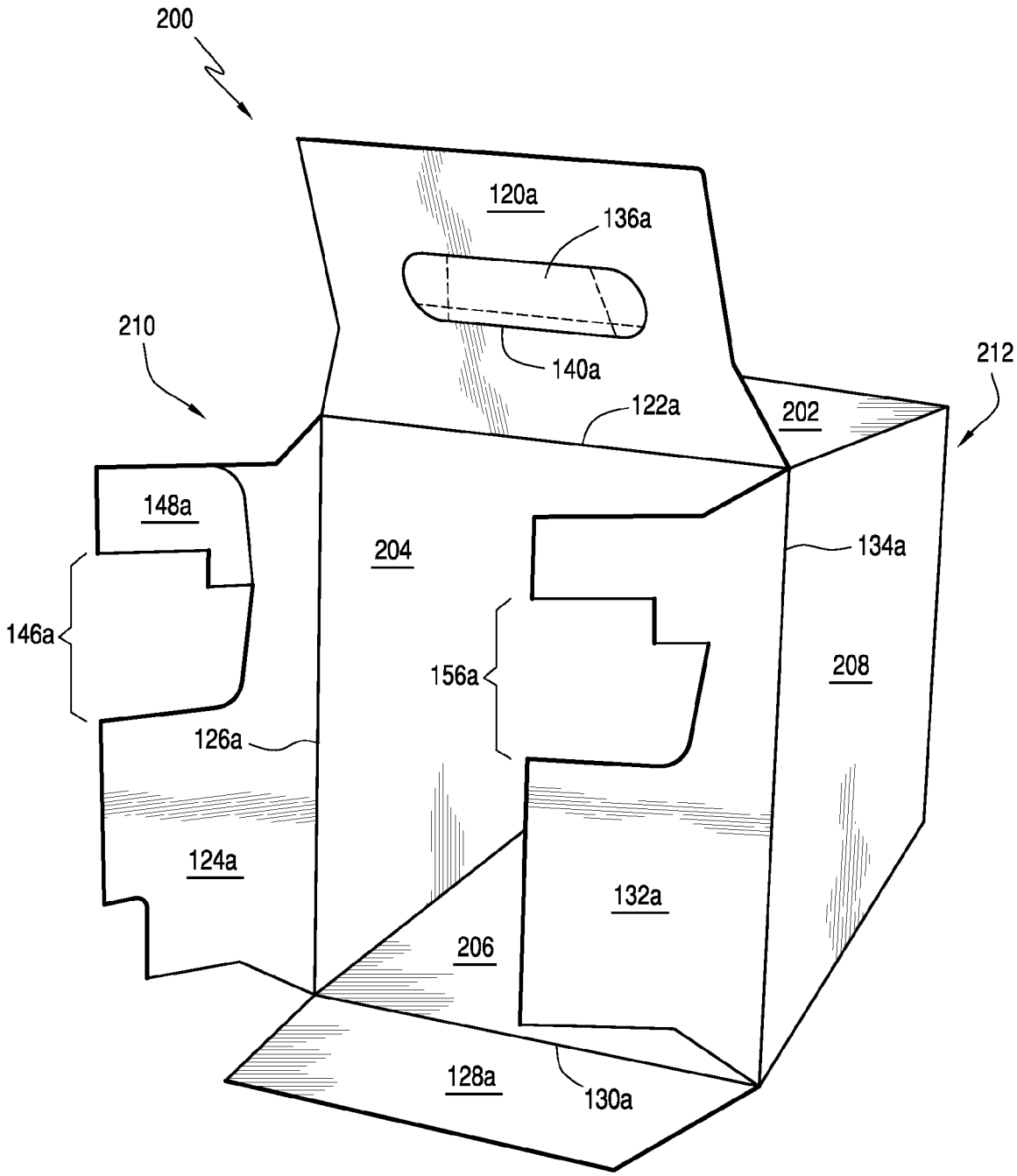
FIG. 9 is a perspective view of a partially erected carton formed from the blank of FIG. 1 prior to sealing one of its end closures.
Figure 10:
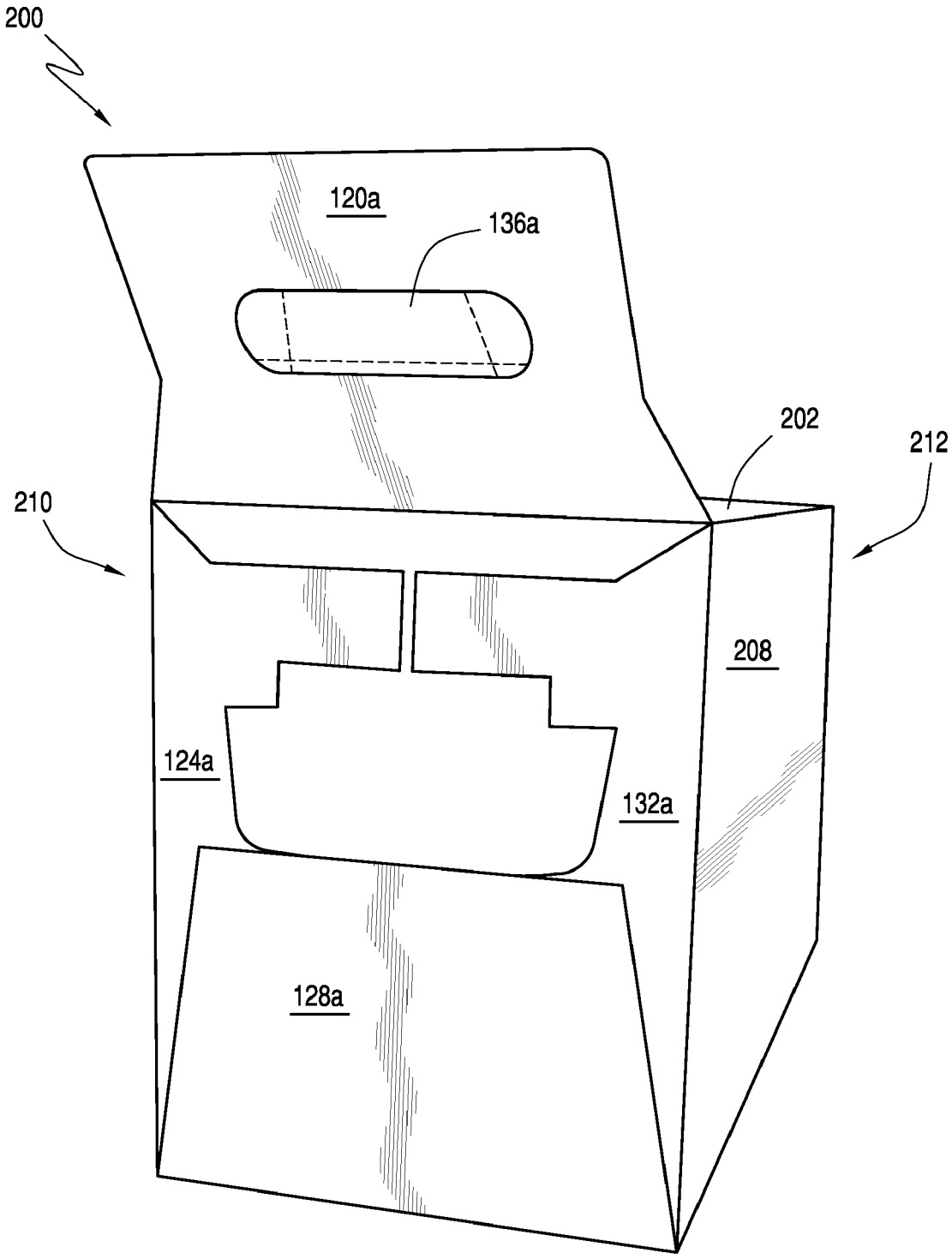
FIG. 10 is a perspective view of a partially erected carton formed from the blank of FIG. 1 with its top end flap raised prior to sealing one of its end closures.
Figure 11:
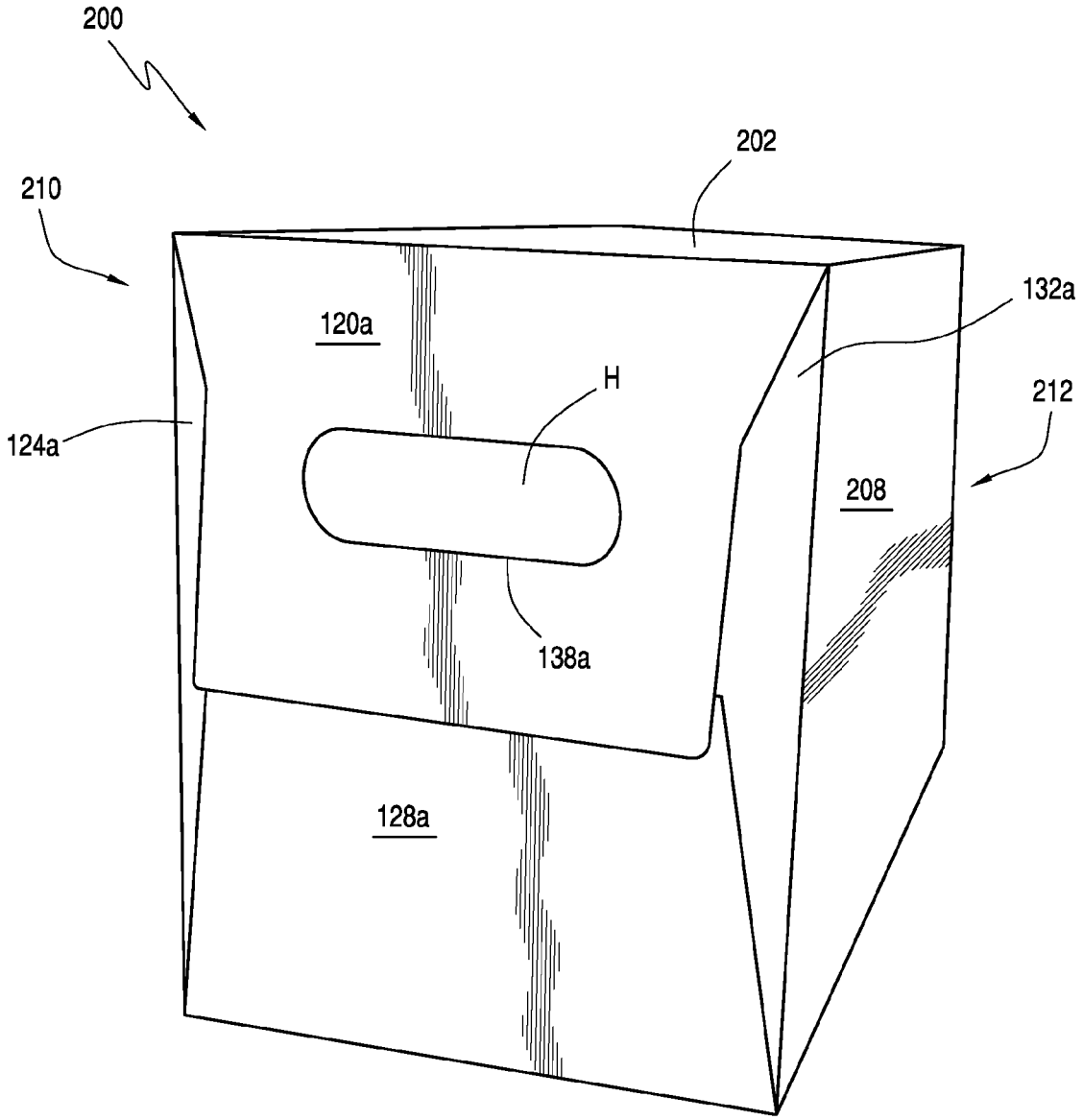
FIG. 11 is a perspective view of a fully erected carton formed from the blank of FIG. 1.

The cushioning flap 136*a* has a complementary position to the end flap cut outs 146*a* and 156*a* so as to be placed in registry with the end flap cut outs 146*a* and 156*a* when the end flaps 120*a*, 124*a*, 132*a* are folded to overlie, overlap, or abut one another to form a first end closure 210 (shown in FIGS. 9-11). Similarly, the cushioning flap 136*b* has a complementary position to the end flap cut outs 146*b* and 156*b* so as to be placed in registry with the end flap cut outs 146*b* and 156*b* when the end flaps 120*b*, 124*b*, 132*b* are folded to overlie, overlap, or abut one another to form a second end closure 212.

The dimensions and shapes of the end flaps 120*a*, 124*a*, 132*a* also correlate to be foldable to provide a composite end closure 210 with a reinforced end handle H. The width X of first side end flaps 124*a*, 124*b* and second side end flaps 132*a*, 132*b*, as defined by the distance from fold lines 126*a*, 126*b*, 134*a*, 134*b* to the outer edges of the respective end flap is no greater than the lesser of one half of either the length Y of the end edges of top panel 102, as defined by fold lines 122*a*, 122*b* or one half of the length Z of the end edges of the bottom panel 106, as defined by fold lines 130*a*, 130*b*. The end edges of the bottom panel 106 may be substantially equal in length to the end edges of the top panel 102, thereby creating a carton with a substantially rectangular tubular cross section. Alternatively, the end edges of top panel 102 may differ in length from the end edges of bottom panel 106, thereby creating a carton with a substantially trapezoidal cross section or a gabled tubular cross section (not shown) having shoulders, as is known in the art. The trapezoidal or gabled cross section with a relatively larger base is particularly useful to enclose tapered articles such as beer bottles. As another alternative (as in the example shown below in FIG. 15), the width X of any or all of the side end flaps may be equal to or less than the lengths Y or Z in which case the side end flaps will at least partially overlap one another to form the composite end closure 210.

The exemplary carton 200 may be erected around an article or group of articles, or may be at least partially erected and then loaded and sealed. To facilitate an understanding of the configuration of the carton 200, one of potentially many contemplated techniques for erecting the carton 200 will now be described as a series of steps that may be performed substantially simultaneously or in any practical order, with some or all of the steps being performed either manually or automatically, such as by a packaging machine (not shown).

The exemplary process of erecting the carton is performed in two stages. The first stage is performed typically as part of the process of manufacturing the carton 200. In the first stage, a blank is cut, folded and then secured into a flattened tubular condition so that it can be shipped to a packing facility as a sleeve. The following are the details: In plant equipment (IPE) at the manufacturing site cuts the blank 100 from a single sheet of foldable sheet material as described above, and cut, scores, imprints or otherwise defines fold lines, severance lines, and cutout sections. For instance, the portion of endless edges 138*a* and 138*b* not comprising fold lines 140*a* and 140*b*, respectively, can be defined by weakened severance lines enabling the sections to later be broken and folded toward the interior of an assembled carton along lines 140*a* and 140*b*.

Figure 16:
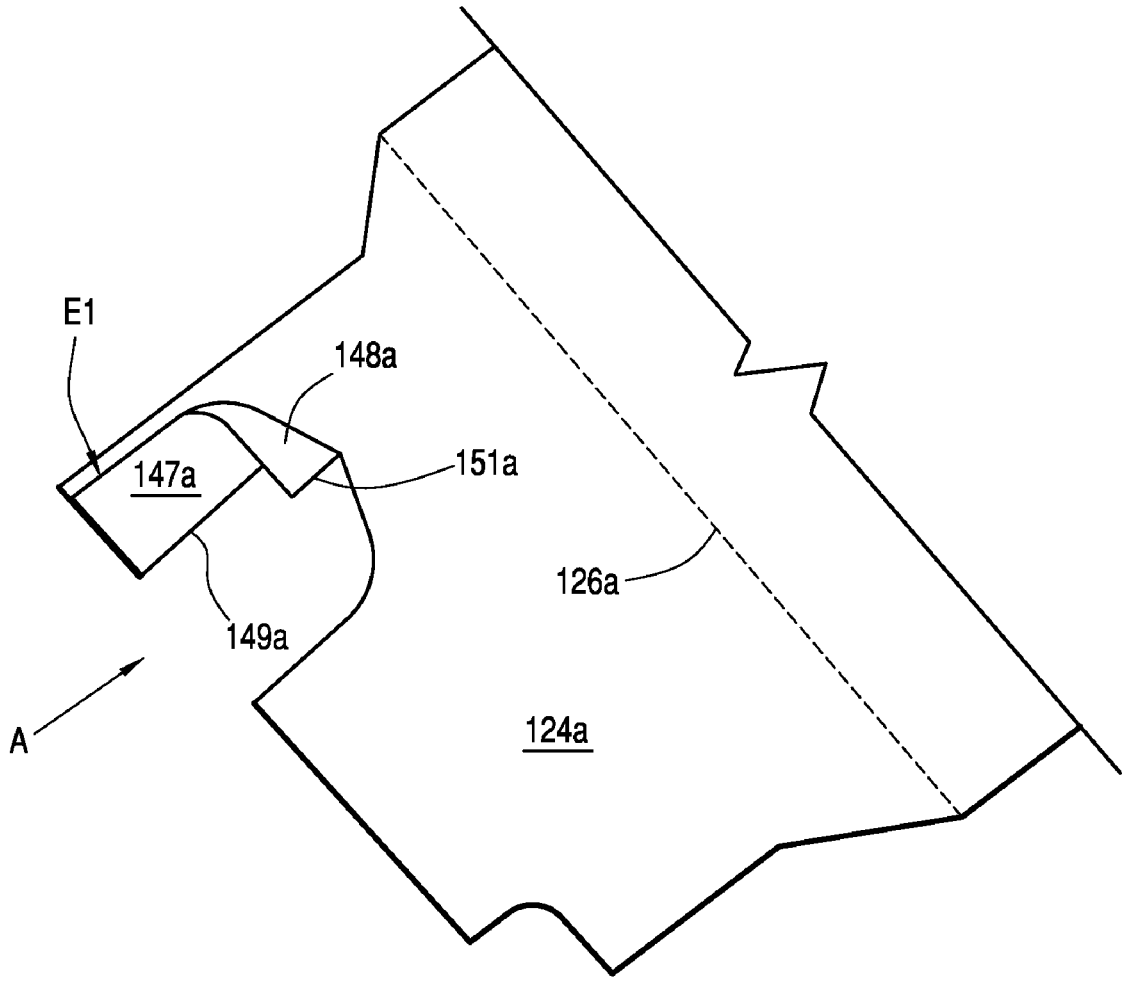
FIG. 16 is perspective view of the side end panel of FIG. 2 showing an alternative folding arrangement to the arrangement shown in FIG. 6, in which the primary reinforcement panel is fold onto the secondary reinforcement panel such that the secondary reinforcement panel is disposed between the primary reinforcement panel and the side end panel.

FIG. 2 shows a detailed perspective view of side end flap 124*a* as the side end flap would be configured following the blank 100 being cut into the form illustrated in FIG. 1. Primary reinforcement flap 147*a* can be folded along fold line 149*a* toward the top left of the figure as shown in FIG. 3 to lie in a substantially flat position against the side end flap 124*a* as shown in FIG. 4. The primary reinforcement flap 147*a* can be attached to the side end flap 124*a* using adhesive or other modes of attachment to hold it in the face contacting arrangement with the side end flap 124*a*. Secondary reinforcement flap 148*a* can be folded along fold line 151*a* toward the top left of the figure as shown in FIG. 5 to lie in a substantially flat position against the side end flap 124*a* and the primary reinforcement flap 147*a* as shown in FIG. 6. The secondary reinforcement flap 148*a* can be attached to the primary reinforcement flap 147*a* and/or the side end flap 124*a* using adhesive or other modes of attachment to hold it in the face contacting arrangement with the primary reinforcement flap 147*a*. As described above, the primary and secondary reinforcement flaps can be scored or cut along the lines 149*a*, 151*a* respectively to permit a sharper crease or a completely severed fold at lines 149*a*, and 151*a*. Alternatively to the arrangement shown in FIG. 6, the primary and secondary reinforcement flaps 147*a*, 148*a* may be folded in a reverse sequence as shown in FIG. 16 in which the primary reinforcement flap 147*a* is fold onto the secondary reinforcement flap 148*a* such that the secondary reinforcement panel 148*a* is sandwiched between the primary reinforcement panel 147*a* and the side end flap 124*a*.

Figure 7:
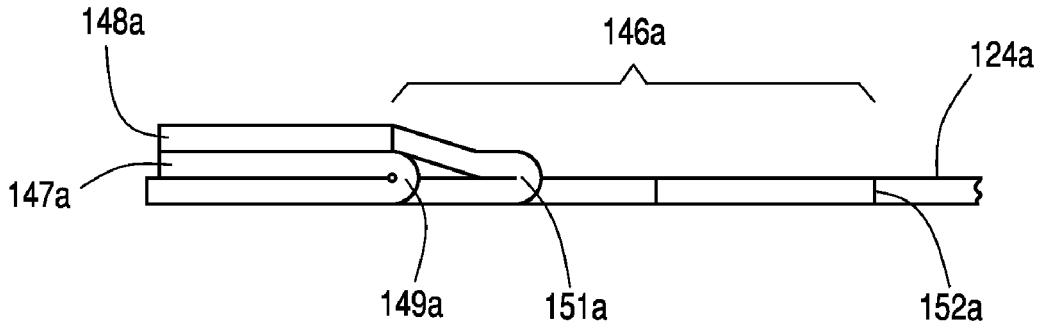
FIG. 7 is an edge view of the side end panel of FIG. 6 in the direction A shown in FIG. 6 showing folded reinforcement panels.
Figure 8:
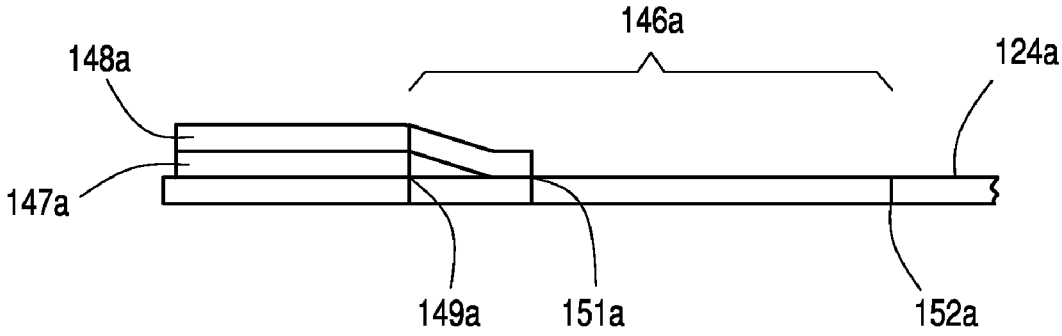
FIG. 8 is an edge view of the side end panel of FIG. 6 in the direction A shown in FIG. 6 showing cut reinforcement panels.

FIG. 7 depicts a view of side end flap 124*a* in the configuration of the flap shown in FIG. 6. as viewed on edge from a direction A shown in FIG. 6. where the primary and secondary reinforcement flaps 147*a*, 148*a* are folded along lines 149*a*, 151*a*. FIG. 8 depicts a similar view where the primary and secondary reinforcement flaps are cut at lines 150*a*, 152*a*, respectively. As can be seen in FIG. 7 and FIG. 8, the folding of the primary and secondary reinforcement flaps as described above creates a multiple ply reinforcement area in the side end flap 124*a*. The reinforced area comprises three plies: a side end flap ply, a primary reinforcement flap ply, and a secondary reinforcement flap ply. It should be noted that the thickness of each ply is exaggerated in the figures for ease of viewing.

The primary reinforcement flaps 147*b*, 157*a*, 157*b*, and secondary reinforcement flaps 148*b*, 158*a*, 158*b*, of side end flaps 124*b*, 132, 132*b*, respectively can be similarly folded in a manner consistent with that described for reinforcement flaps 147*a* and 148*a* of side end flap 124*a*. Then, the edge flap 116 is folded over into a face contacting arrangement with top panel 102, adhesive is applied to the edge flap 116 and the blank is folded over at fold line 112 such that the edge flap 116 is secured to the second side panel 108. In this condition, the blank 100 is transformed into a flattened tubular structure that can be shipped and erected using automated equipment.

The second stage of erecting the carton 200 may be performed at a bottling or packaging facility. The flattened blanks 100 are loaded into a packaging machine, which in known fashion, disposes top panel 102 opposite bottom panel 106 and disposes first side panel 104 opposite second side panel 108 so that the carton 200 is configured as a tubular sleeve having a substantially rectangular as shown in FIG. 9, although trapezoidal or gabled cross sections are also contemplated. Thus, top panel 102 becomes top wall 202, first side panel 104 becomes first side wall 204, bottom panel 106 becomes bottom wall 206, and second side panel 108 becomes second side wall 208.

Articles are loaded into the carton 200 through one or both of the now open ends, and then the ends are sealed. The ends of the carton 200 are substantially identical, with similar parts being identified using the same element number modified by the suffix "a" or "b", where element numbers ending in "a" are associated with end closure 210, and elements identified with "b" are associated with the end closure 212. Accordingly, formation of only one of the end closures 210, 212 will be described in detail below.

As can be seen in FIG. 9, first side panel 124*a* and second side panel 132*a* are folded toward the interior of the carton 200 until these panels substantially line in a plane which includes the fold lines 122*a*, 126*a*, 130*a*, and 134*a*. In this manner, the cutouts 146*a* and 156*a*, corresponding to the handle opening created upon the punch out of cushioning flap 136*a*, come together such that the tops of the cutouts 146*a* and 156*a* are in substantial alignment with the fold line 140*a* of the cushioning flap 136*a* when the top end flap 120*a* is closed as described below. It should be noted that the alignment of the cushioning flap 136*a* in relation to the handle cutouts 146*a* and 156*a* can have slight variations and need not be exact. Adhesive is applied to the inside surface of the bottom end flap 128*a*, or to the outside surfaces of the first and second side end flaps, and bottom end flap 128*a* is folded toward the interior of the carton 200 so that its inside surface is secured in a face contacting arrangement to the lower portions of the outside surfaces of side end flaps 124*a*, 132*a*. At this point the carton 200 appears as depicted in FIG. 10.

Adhesive is applied to the inside surface of the top end flap 120*a* or to the outside surface of the bottom end flap and/or the side end flaps, and the top end flap 120*a* is folded toward the interior of the carton 200 so that its inside surface is secured in a face contacting arrangement to the upper portions of the outside surfaces of the side end flaps 124*a*, 132*a*. The top end flap 120*a* may overlap bottom end flap 128*a* somewhat (as shown in FIG. 11), or conversely, the bottom end flap 128*a* may overlap top end flap 120*a*.

Once the carton 200 is fully erected as shown in FIG. 11, each end closure 210, 212 includes a handle H upon the cushioning flap 136*a* being punched out along and folded into the interior of the carton. The upper edge of the handle H is reinforced. An upper portion of the periphery of the handle H as defined by the edge 138*a* is substantially aligned with and reinforced by the side end panel 124*a* at the fold line 149*a* and by side end panel 132*a* at fold line 159*a*. The primary reinforcement flaps 147*a*, 157*a*, and secondary reinforcement flaps 148*a*, 158*a* provide additional reinforcement plies. The handle H includes a first ply comprising top end flap 120*a*, a second ply comprising side end flaps 124*a* and 132*a*, a third ply comprising primary reinforcement flaps 147*a*, 157*a*, and a fourth ply comprising secondary reinforcement flaps 148*a*, 158*a*. Those skilled in the art will readily appreciate that reinforcement is most needed along the weight-bearing portion of a handle opening in a carton which is where the embodiment described above provides reinforcement of the handle H.

Figure 12:
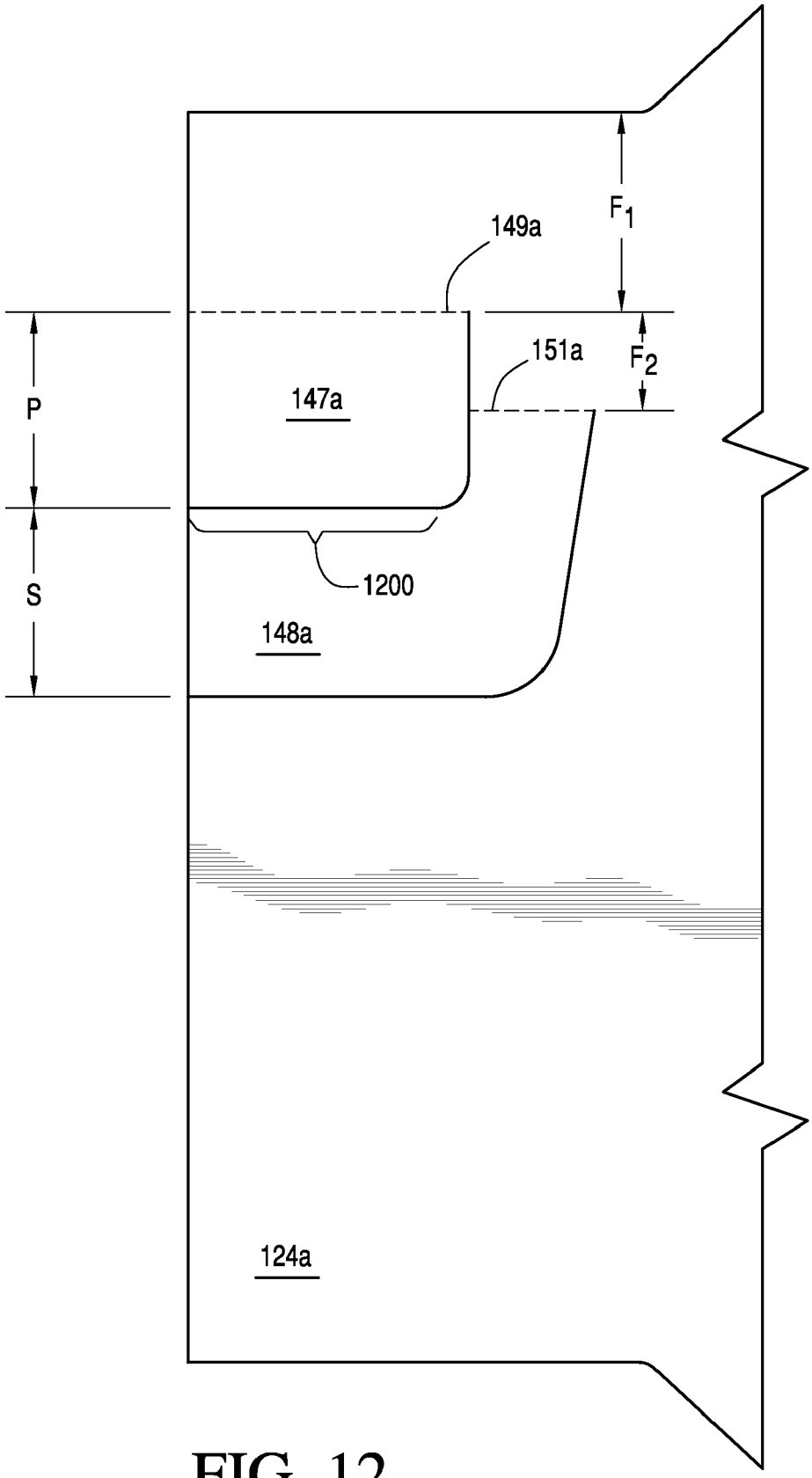
FIG. 12 is a partial plan view showing a side end flap of the blank of FIG. 1.

FIG. 12 depicts the side end panel 124*a* in a close up view so that spatial relationships between the primary reinforcement panel and the secondary reinforcement panel can be explained. The distance from the top edge of the side end panel to the fold line 149*a* is marked as F1 in FIG. 12. The vertical length of the primary reinforcement panel 147*a* is designated as P. For the embodiment depicted, F1 is substantially equal to P. This relationship permits the portion of side end panel 124*a* above primary reinforcement panel 147*a* to be reinforced while preventing primary reinforcement panel 147*a* from extending beyond the top edge of side end panel 124*a*. It should be understood that this substantially equal relationship between F1 and P is not required and that other configurations are within the scope of the present invention. For instance, the length P may be slightly or substantially less than the distance F1.

The vertical length of the reinforcing portion of the secondary reinforcement panel 148*a* is designated as S in FIG. 12. The vertical distance between primary reinforcement panel 147*a* and secondary enforcement panel 148*a* is designated as F2. In the embodiment pictured, S is substantially equal to P. It should be understood that this relationship between S and P is not required and that other configurations are within the scope of the present invention. For alignment of the edge segment 1200 of secondary reinforcement panel 148*a* with the fold line 149*a*, the distance F2 should substantially equal one half of P. This relationship will place edge segment 1200 is substantial alignment with fold line 149*a*.

Figure 13:
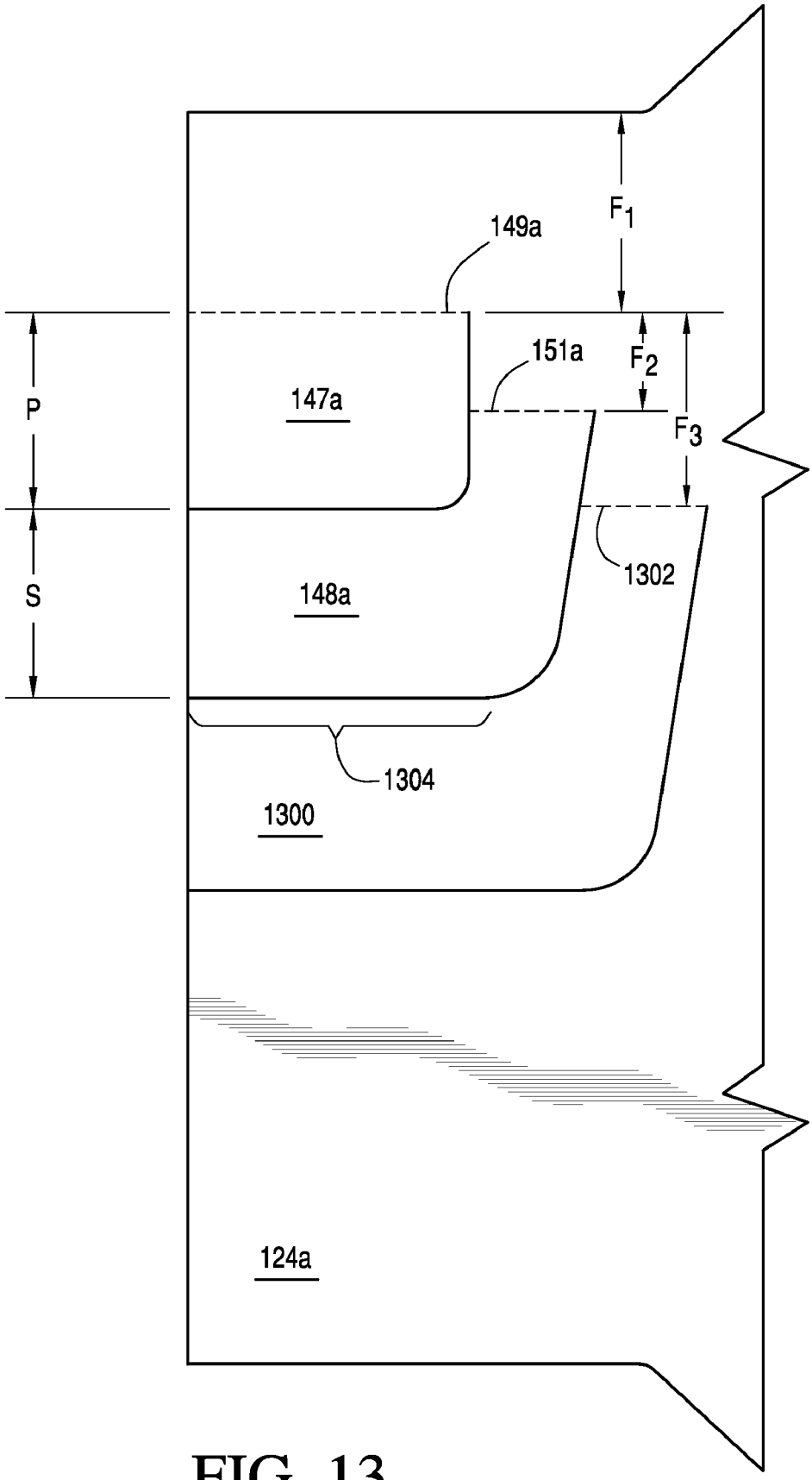
FIG. 13 is a partial plan view showing a side end flap of an embodiment incorporating a tertiary reinforcement panel.

This relationship can be generalized and extended to alternative embodiments which include additional reinforcement flaps. For example, FIG. 13 shows a side end flap 124*a* having a tertiary reinforcement flap 1300 having fold line 1302. To provide proper alignment of edge segment 1304 of the tertiary reinforcement flap 1300 with the fold line 149*a* when the tertiary reinforcement flap is folded into place, the vertical distance F3 between fold line 1302 and fold line 149*a* can be substantially equal to one half of the vertical distance between the edge segment 1304 and fold line 149*a*. Although the number of additional reinforcement plies is limited by the available side end flap material, this relationship (i.e., the vertical distance between the primary reinforcement flap fold line and the fold line for the nth reinforcement panel being substantially equal to one half of the vertical distance between the primary reinforcement flap fold line and an upper edge segment of the nth reinforcement panel) can be used to orient as many additional plies at the side end flap material will allow without unduly sacrificing the structural integrity of the carton.

Figure 14:
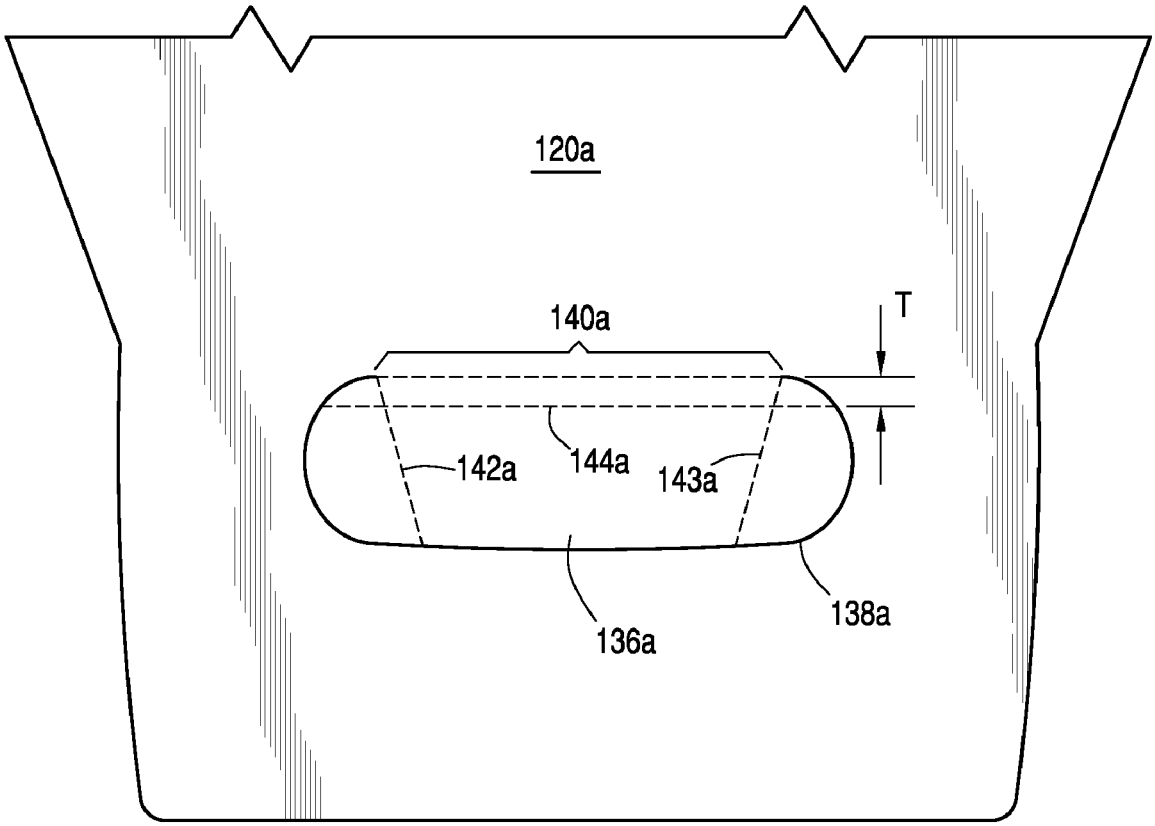
FIG. 14 is a partial plan view showing a top end flap of the blank of FIG. 1.

Returning to the embodiment of FIG. 1, FIG. 14 shows a detailed view of the top end flap 120*a* and the cushioning flap 136*a*. As described above, the cushioning flap can be punched out, and pushed into the carton 200 by the hand of a carrier of the carton to create handle H. Once the handle H is so formed, the outer edge of the handle H is defined by endless edge 138*a*. The cushioning flap 136*a* remains attached at a segment 140*a* of endless edge 138*a*. Segment 140*a* comprises a primary fold line of the cushioning handle 136*a*. The remainder of endless edge 138*a* can comprise a severance line such that the fingers of a hand can break the cushioning flap away from the top end flap 120*a* to fold the flap into the interior of the carton. Fold lines 140*a*, 142*a*, 143*a*, and 144*a* can be scored to enable easier folding of the carton material. Fold lines 142*a* and 143*a* can enable the sides of the cushioning flap 136*a* to bend so as not to interfere with the folding of the cushioning flap into the interior of the carton 200. Fold line 144*a* comprises a secondary fold line of the cushioning handle 136*a* and permits the cushioning flap to be more easily folded around the multiple ply reinforced area above the handle H. The fold line 144*a* can be placed at a vertical distance T below the fold line 140*a*. The distance T can be based on the number of plies which the cushioning flap 136*a* is to be folded around. For example, if the cushioning flap is to be folded into the carton 200 where the reinforced area comprises a side end flap ply, a primary reinforcement flap ply, and a secondary reinforcement flap ply, the fold line 144*a* can be placed at a distance T below the fold line 140*a* that is greater than or equal to the number of plies (in this case three) multiplied by the thickness of the sheet material used to construct the carton 200. This arrangement permits the cushioning flap 136*a* to be more easily manipulated into a folded position. Following the cushioning flap 136*a* being folded into the interior of the carton, the plies of carton material above the handle area (from the outside to the inside of the carton) can comprise the 1) upper end flap 120, 2) the side flaps 124*a*, 132*a*, 3) the primary reinforcement flaps 147*a*, 157*a*, 4) the secondary reinforcement flaps 148*a*, 158*a*, and 5) the cushioning flap 136*a*, where the upper end flap 120*a*/cushioning flap 136*a* wrap around the reinforcement plies at fold lines 140*a* and 144*a*.

Figure 15:
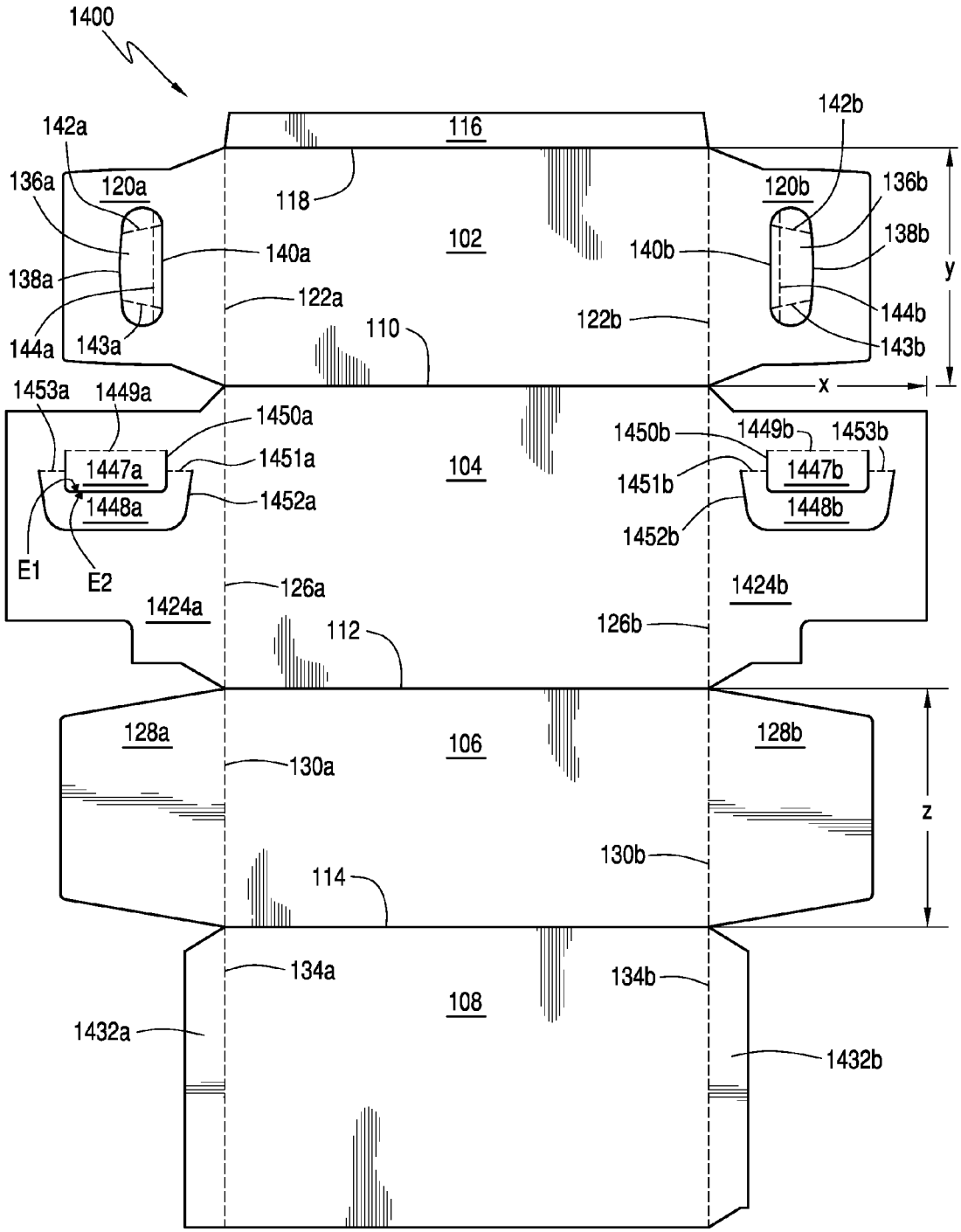
FIG. 15 is a plan view of a blank for forming a carton according to an alternative exemplary embodiment of the invention.

FIG. 15 shows an alternative embodiment of a carton blank 1400 according to the present invention. The embodiment pictured is similar to the carton blank 100 embodiment shown in FIG. 1 with the exception of the side end flaps. The side end flaps 1424*a*, 1424*b* of the blank 1400 have a greater width than the side end flaps 124*a*, 124*b* of blank 100. In addition, the edge flaps 1432*a*, 1432*b* are used in blank 1400 in place of the side end flaps 132*a*, 132*b* of blank 100. The edge flaps 1432*a*, 1432*b* provide a surface to which the side end flaps 1424*a*, 1424*b* can be attached, respectively, when the side end flaps 1424*a*, 1424*b* are closed to form a carton from the blank 1400.

A cutout area for handles H of a carton the blank 1400 is formed in each of the side end flaps 1424*a*, 1424*b*, such that when the carton is assembled, the fingers of a user's hand can extend though the handle openings and into the interior of the carton. As described above with respect to blank 100, the sheet material formerly in the handle cutout areas of blank 1400 is not removed from the end flaps and merely discarded, but is instead repositioned to create a multiple ply reinforcement area for the handles H. Primary reinforcement flaps 1447*a*, 1447*b*, are cut along severance lines 1450*a*, 1450*b* and folded along lines 1449*a*, 1449*b* toward the interior of the carton, respectively. The fold lines 1449*a*, 1449*b* can be scored or otherwise weakened to permit a tighter fold. Alternatively, the primary reinforcement flaps can be separated along lines 1449*a*, 1449*b* and repositioned as if folded at these lines. The primary reinforcement flaps 1447*a* and 1447*b* are to be folded upward. The primary reinforcement flaps 1447*a*, 1447*b* can be held in a face contacting arrangement with the side end flaps 1424*a*, 1424*b* respectively using adhesive or other modes of attachment. Each of the secondary reinforcement flaps 1448*a*, 1448*b* is hingedly connected to the respective side end flap 1424*a*, 1424*b* along a respective pair of spaced collinear second fold lines 1451*a*, 1453*a*; 1451*b*, 1453*b*. Each secondary reinforcement flap 1448*a*, 1448*b* has a reinforcing edge E2 extending between the respective second fold lines 1451*a*, 1453*a*; 1451*b*, 1453*b*. The secondary reinforcement flaps 1448*a*, 1448*b* are to be folded out of the plane of the side end flaps 1424*a*, 1424*b* about the second fold lines 1451*a*, 1453*a*; 1451*b*, 1453*b* to place the respective reinforcing edges E2 in reinforcing proximity to the handle openings. The secondary reinforcement flaps 1448*a*, 1448*b* are cut along severance lines 1452*a*, 1452*b* and folded along fold lines 1451*a*, 1453*a* (for secondary reinforcement flap 1448*a*), and 1451*b*, 1453*b* (for secondary reinforcement flap 1448*b*) toward the interior of the carton. The fold lines 1451*a*, 1453*a*, 1451*b*, 1453*b* can be scored or otherwise weakened to permit a tighter fold. It can be seen from that the distal edge E1 of the primary reinforcement flap 1447*a* is defined by the reinforcing edge E2 of the secondary reinforcement flap 1448*a*.

Alternatively, the secondary reinforcement flaps can be cut along lines 1451*a*, 1453*b*, 1451*b*, 1453*b* and repositioned as if folded at these lines. The secondary reinforcement flaps 1448*a* and 1448*b* are to be folded upward. The secondary reinforcement flaps 1448*a*, 1448*b* can be held in a face contacting position to the primary reinforcement flaps 1447*a*, 1447*b*, respectively using adhesive or other modes of attachment.

The present invention has been illustrated in relation to a particular embodiment which is intended in all respects to be illustrative rather than restrictive. For example, as used herein, directional references such as "top", "base", "bottom", "end", "side", "inner", "outer", "upper", "middle", "lower", "front" and "rear" do not limit the respective walls of the carton to such orientation, but merely serve to distinguish these walls from one another. Furthermore, the various embodiments demonstrate that the top, sides, and bottom panels may be hingedly connected to one another and secured into a tubular sleeve in any order that provides a top panel opposing a bottom panel and opposing side panels. Any reference to hinged connection should not be construed as necessarily referring to a junction including a single hinge only; indeed, it is envisaged that hinged connection can be formed from one or more potentially disparate means for hingedly connecting materials. The exemplary cartons preferably have handles at both ends, although it is contemplated to include only one handle disposed in one of the end closures.

As used herein, the terms "fold line" and "severance line" refer to all manner of lines indicating optimal fold or cut locations, frangible or otherwise weakened lines, perforations, a line of perforations, a line of short slits, a line of half-cuts, a single half-cut, a cut line, scored lines, slits, any combination thereof, and the like.

Those skilled in the art will also appreciate that any suitable means for securing sheet material may be used, including magnets, non-permanent adhesives, or hook and loop fasteners such as VELCRO®, which is a trademark registered to Velcro Industries B.V. Additionally, although the handle openings of the invention are described as having removable centers, the centers may be only partially removable and may function as finger cushions after being partially detached from the edges of the handle openings.

Hence, the above-described embodiments are merely exemplary illustrations of implementations set forth for a clear understanding of the principles of the invention. Many variations and modifications may be made to the above-described embodiments without departing from the scope of the claims. Accordingly, all such modifications, combinations, and variations are included herein by the scope of this disclosure and the following claims.

What is claimed is:

1. A carton comprising a first handle panel having a cutout for defining in the proximity thereof a handle area by which the carton may be lifted, the cutout having a pair of first and second opposed edges, the handle panel being provided with a handle-reinforcing arrangement comprising first and second reinforcing flaps, the first reinforcing flap being hingedly connected to the handle panel along the first edge and folded about the first edge to reinforce the handle area, the second reinforcing flap being hingedly connected to the handle panel along a second flap fold line and folded about the second flap fold line to reinforce the handle area, the second flap fold line being disposed between the first and second edges of the cutout such that the second flap fold line is spaced from the first edge, wherein the second flap fold line is disposed such that the second flap fold line defines a part of a perimeter of the cutout, wherein the first reinforcing flap is directly connected to the handle panel along the first edge, and the second reinforcing flap is directly connected to the handle panel along the second flap fold line.

2. The carton of claim 1, wherein the first edge of the cutout is substantially linear, and the second flap fold line is substantially parallel to the first edge.

3. The carton of claim 1, wherein the first and second reinforcing flaps are struck from the handle panel such that at least a part of the cutout is defined by folding the first and second reinforcing flaps out of the plane of the handle panel.

4. The carton of claim 1, wherein the first reinforcing flap is folded on the handle panel to reinforce the handle area, and the second reinforcing flap is folded on the first reinforcing flap so that the first reinforcing flap is sandwiched between the second reinforcing flap and the handle panel.

5. The carton of claim 1, wherein the second reinforcing flap is folded on the handle panel to reinforce the handle area, and the first reinforcing flap is folded on the second reinforcing flap so that the second reinforcing flap is sandwiched between the first reinforcing flap and the handle panel.

6. The carton of claim 1, wherein the handle-reinforcing arrangement further comprises a third reinforcing flap hingedly connected to the handle panel along a third flap fold line and folded about the third flap fold line to reinforce the handle area, the third flap fold line being disposed between the second flap fold line and second edge of the cutout such that the third flap fold line is spaced from the second flap fold line edge.

7. The carton of claim 6, wherein the third flap fold line is disposed such that the third flap fold line defines a part of a perimeter of the cutout.

8. The carton of claim 1, further comprising a second handle panel having a handle opening, and the second handle panel is disposed in face-contacting relationship with the first handle panel such that the handle opening is aligned with at least a part of the cutout.

9. A carton, comprising:

a tubular structure including a top panel, a bottom panel and a pair of first and second opposed side panels; and at least one end closure that comprises:

a top end flap hingedly connected to the top panel, the top end flap including a handle opening;

a first side end flap hingedly connected to the first side panel; and a second side end flap hingedly connected to the second side panel, each of the first and second side end flaps comprising a cutout having dimensions complementary to the dimensions of at least part of the handle opening, wherein the top end flap is folded to at least partially overlie the first and second side end flaps so that the handle opening is in registry with at least part of the cutouts in the first and second side end flaps, each of the first and second side end flaps further comprising:

a first reinforcement flap formed from the each side end flap and hingedly connected to the each side end flap, the first reinforcement flap being repositioned from the plane of the each side end flap to place a reinforcing edge thereof in reinforcing proximity to the handle opening; and a second reinforcement flap formed from the each side end flap and hingedly connected to the each side end flap, the second reinforcement flap being repositioned from the plane of the each side end panel to place a reinforcing edge thereof in reinforcing proximity to the handle opening, wherein the first reinforcement flap is directly connected to the each side end flap, and the second reinforcement flap is directly connected to the each side end flap.

10. The carton of claim 9, wherein the at least one end closure further comprises a bottom end flap hingedly connected to an end edge of the bottom panel, the bottom end flap at least partially overlying the first and second side end flaps of the at least one end closure.

11. The carton of claim 10, wherein the top end flap of the at least one end closure at least partially overlaps the bottom end flap.

12. The carton of claim 9, wherein the first and second side end flaps of the at least one end closure have end edges along which the cutouts of the first and second side end flaps are defined respectively, the end edges of the first and second side end flaps being disposed adjacent to each other such that the first and second side end flaps lie in the same plane without overlapping each other.

13. The carton of claim 12, wherein the cutouts of the first and second side end flaps of the at least one end closure are aligned to form an aperture that is disposed in registry with a part of the handle opening.

14. A carton comprising a substantially tubular body and an end closure for at least partially closing at least one of opposed ends of the tubular body, the end closure comprising a primary end flap having a handle opening for receiving fingers of a user's hand and at least one reinforcing panel disposed in a face-contacting relationship with the primary end flap, the at least one reinforcing panel comprising first and second reinforcing flaps formed from the at least one reinforcing panel, the first reinforcing flap being hingedly connected to the at least one reinforcing panel along a first fold line and having a free edge opposed to the first fold line, the first reinforcing flap being folded out of the plane of the at least one reinforcing panel about the first fold line to place the first reinforcing flap in reinforcing proximity to the handle opening, the second reinforcing flap hingedly connected to the at least one reinforcing panel along a pair of spaced collinear second fold lines and having a reinforcing edge extending between the second fold lines, the second reinforcing flap being folded out of the plane of the at least one reinforcing panel about the second fold lines to place the reinforcing edge in reinforcing proximity to the handle opening, the free edge of the first reinforcing flap being defined by the reinforcing edge of the second reinforcing flap when the first and second reinforcing flaps are in the plane of the at least one reinforcing panel.

15. The carton of claim 14, wherein the first reinforcing flap is folded into a substantially flat position against the at least one reinforcing panel to reinforce the handle area, and the second reinforcing flap is folded into a substantially flat position against the first reinforcing flap so that the first reinforcing flap is sandwiched between the second reinforcing flap and the handle panel.

16. The carton of claim 14, wherein the second reinforcing flap is folded into a substantially flat position against the handle panel to reinforce the handle area, and the first reinforcing flap is folded into a substantially flat position against the second reinforcing flap so that the second reinforcing flap is sandwiched between the first reinforcing flap and the handle panel.

17. The carton of claim 14, wherein the first reinforcing flap is directly connected to the at least one reinforcing panel along the first edge, and the second reinforcing flap is directly connected to the at least one reinforcing panel along the second flap fold line.

18. A carton blank comprising an end closure panel arrangement, the end closure panel arrangement comprising a primary end flap having a handle opening for receiving fingers of a user's hand and at least one reinforcing panel, the at least one reinforcing panel comprising first and second reinforcing flaps formed from the at least one reinforcing panel, the first reinforcing flap being hingedly connected to the at least one reinforcing panel along a first fold line and having a free edge opposed to the first fold line, the second reinforcing flap hingedly connected to the at least one reinforcing panel along a pair of spaced collinear second fold lines and having a reinforcing edge extending between the second fold lines, the free edge of the first reinforcing flap being defined by the reinforcing edge of the second reinforcing flap.

19. The blank of claim 18, wherein the first reinforcing flap is directly connected to the at least one reinforcing panel along the first edge, and the second reinforcing flap is directly connected to the at least one reinforcing panel along the second flap fold line.

20. A blank for forming a carton, the blank comprising a first handle panel having a cutout for defining in the proximity thereof a handle area by which the carton may be lifted, the cutout having a pair of first and second opposed edges, the handle panel being provided with a handle-reinforcing arrangement comprising first and second reinforcing flaps, the first reinforcing flap being hingedly connected to the handle panel along the first edge to reinforce the handle area when folded about the first edge, the second reinforcing flap being hingedly connected to the handle panel along a second flap fold line to reinforce the handle area when folded about the second flap fold line, the second flap fold line being disposed between the first and second edges of the cutout such that the second flap fold line is spaced from the first edge, wherein the second flap fold line is disposed such that the second flap fold line defines a part of a perimeter of the cutout, wherein the first reinforcing flap is directly connected to the handle panel along the first edge, and the second reinforcing flap is directly connected to the handle panel along the second flap fold line.

* * * * *